US009309610B2

(12) United States Patent
Crawford et al.

(10) Patent No.: US 9,309,610 B2
(45) **Date of Patent: *Apr. 12, 2016**

(54) HELICAL TEXTILE WITH UNIFORM THICKNESS

(71) Applicant: Crawford Textile Fabrications, LLC, Portsmouth, NH (US)

(72) Inventors: James A. Crawford, Portsmouth, NH (US); Susan Crawford, Portsmouth, NH (US)

(73) Assignee: Crawford Textile Fabrications, LLC, Portsmouth, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/751,296

(22) Filed: Jan. 28, 2013

(65) Prior Publication Data

US 2013/0251973 A1 Sep. 26, 2013

Related U.S. Application Data

(63) Continuation-in-part of application No. 12/050,789, filed on Mar. 18, 2008, now Pat. No. 8,486,517.

(51) Int. Cl.

| | |
|---|---|
| ***D02G 3/02*** | (2006.01) |
| ***D03D 3/00*** | (2006.01) |
| ***D04B 21/20*** | (2006.01) |

(Continued)

(52) U.S. Cl.

CPC *D03D 3/00* (2013.01); *D04B 21/20* (2013.01); *D04B 23/12* (2013.01); *D04B 27/34* (2013.01); *D10B 2505/02* (2013.01); *Y10T 428/249922* (2015.04); *Y10T 442/645* (2015.04); *Y10T 442/659* (2015.04)

(58) Field of Classification Search

None

See application file for complete search history.

(56) References Cited

U.S. PATENT DOCUMENTS

| | | | | |
|---|---|---|---|---|
| 1,346,136 | A | 7/1920 | Schwab | |
| 4,341,830 | A | 7/1982 | Betts et al. | |
| 6,706,376 | B1 * | 3/2004 | Von Fransecky | 428/212 |

(Continued)

FOREIGN PATENT DOCUMENTS

DE 102007038931 A1 2/2009

OTHER PUBLICATIONS

European Patent Office, Supplementary European Search Report, EP Application No. 09 72 1263 (Apr. 25, 2014).

(Continued)

*Primary Examiner* — Katarzyna Wyrozebski
*Assistant Examiner* — Shawnda McKinnon
(74) *Attorney, Agent, or Firm* — Mesmer & Deleault PLLC

(57) ABSTRACT

A helical textile with a substantially uniform thickness has circumferential warp fibers defining a radial textile width from a textile inner diameter to a textile outer diameter. The circumferential warp fibers extend substantially in a first fiber direction. Weft fibers are inserted in a weft region between the textile inner diameter and the textile outer diameter extend substantially in a second fiber direction along a weft fiber axis. The weft fiber axis has a predefined angle with respect to a radial axis greater than zero degrees and less than ninety degrees. Knitted chain stitches secure the weft fibers to the circumferential warp fibers, where the knitted chain stitches are knitted across the weft region in a third fiber direction. The circumferential warp fibers and the weft fibers are non-interlaced, thereby forming a helical textile having a substantially uniform thickness from the textile inner diameter to the textile outer diameter.

19 Claims, 15 Drawing Sheets

(51) Int. Cl.
*D04B 23/12* (2006.01)
*D04B 27/34* (2006.01)

(56) References Cited

U.S. PATENT DOCUMENTS 7,120,975 B2 * 10/2006 Delecroix ..... 28/101
2003/0106751 A1 6/2003 Bauer et al.
2007/0079886 A1 * 4/2007 Ge ..... 139/11
2009/0239054 A1 * 9/2009 Crawford, Jr. ..... 428/222
2011/0014403 A1 * 1/2011 Wang et al. ..... 428/34.1

OTHER PUBLICATIONS

European Patent Office, Extended European Search Report for EPA 14000297.3-1710 (May 8, 2014).

* cited by examiner

HELICAL TEXTILE WITH UNIFORM THICKNESS

This application is a continuation-in-part of U.S. patent application Ser. No. 12/050,789, filed Mar. 18, 2008.

BACKGROUND

1. Field of the Invention

The present invention relates to textiles. In particular, the present invention relates to a helical textile with uniform thickness.

2. Description of the Related Art

One of the primary purposes of helical or spiral shaped material is to reinforce a composite material. Therefore, the fiber selection, fiber orientation and other features of the textile material must be considered to maximize the effectiveness of the textile material as a reinforcement to the final product.

Others have described woven helical fabrics, such as that disclosed in U.S. Pat. No. 5,222,866 ("the '866 patent") that was issued to LaBrouche et al. In the '866 patent the yarns in the warp (circumferential direction of the spiral) and yarns in the weft (radial direction of the spiral) are interlaced in the manner used with traditional weaving processes and typical weave designs, such as plain weave, satin weave, and basket weave.

One example is shown in FIG. 1. The interlacings produced in the weaving process are necessary to hold the fabric together, and result in a lack of straightness in the yarns in either or both of the warp or weft directions called crimp. Crimp is introduced at fiber interlacings as illustrated in 106*a* through 106*e* between warp yarns 102 and weft yarns 104. The crimp reduces the efficiency of the fibers to translate their properties to the ultimate composite structure or textile material.

Knitting processes can be divided into two categories: warp knitting and weft knitting. Weft knitting results in a textile structure where the yarns are interlocked to adjacent yarns resulting in very tortuous fiber paths. This does not allow for effective reinforcement for high performance composites.

What is needed, therefore, is a helical textile for reinforcing composite materials that does not crimp the fibers, but has uniform thickness, and process for making the same.

SUMMARY OF THE INVENTION

In one embodiment of the present invention, a helical textile does not have interlaced warp and weft fibers, yet has uniform thickness for reinforcing composite materials.

Another embodiment is a warp knit helical textile having a repeating pattern of weft fibers of varying lengths such that the overall textile has a uniform thickness. The warp layers and weft layers are secured with non-reinforcing knitted stitches. One process of making the warp knit helical textile includes a warp knitting machine modified to have conical take-up rolls and a means for inserting the repeating pattern of weft fibers of varying lengths.

In another embodiment, a helical textile with a substantially uniform thickness has circumferential warp fibers defining a radial textile width from a textile inner diameter to a textile outer diameter. The circumferential warp fibers extend substantially in a first fiber direction. Weft fibers are inserted in a weft region between the textile inner diameter and the textile outer diameter and extend substantially in a second fiber direction along a weft fiber axis. The weft fiber axis defines a predefined angle that is greater than zero degrees and less than ninety degrees with respect to a radial axis. Knitted chain stitches secure the weft fibers to the circumferential warp fibers where the knitted chain stitches are knitted across the weft region in a third fiber direction. The circumferential warp fibers and the weft fibers are non-interlaced, thereby forming a helical textile having a substantially uniform thickness from the textile inner diameter to the textile outer diameter.

In another embodiment, the predefined angle is about forty-five degrees. In other embodiments, the predefined angle is between about thirty and about sixty degrees. In other embodiments, the predefined angle is between about ten and about eighty degrees.

In another embodiment, the circumferential warp fibers change between a first hoop position and a second hoop position. In another embodiment, the first hoop position and the second hoop position are separated by at least one additional hoop position.

In another embodiment, the circumferential warp fibers increase in height from the textile inner diameter to the textile outer diameter and decrease in width from the textile inner diameter to the textile outer diameter.

In another embodiment, the circumferential warp fibers have an equal cross-sectional area.

In another embodiment, the weft fibers are parallel to one another.

In another embodiment, the knitted chain stitches secure the weft fibers to the circumferential warp fibers at every crossover point.

In another embodiment, the weft region has a weft region inner diameter greater than the textile inner diameter. In another embodiment, the weft region has a weft region outer diameter smaller than the textile outer diameter. In another embodiment, the weft region inner diameter is greater than the textile inner diameter and the weft region outer diameter is also less than the textile outer diameter.

In another embodiment, the helical textile also has at least one weft fiber being inserted along a first weft fiber axis between a first radial position and a second radial position and being inserted along a second weft fiber axis between a second radial position and a third radial position, wherein the first weft fiber axis defines a first angle with respect to the radial axis and wherein the second weft fiber axis defines a second angle with respect to the radial axis, the second angle being different from the first angle.

In another embodiment, at least one the weft fibers traverses from the textile inner diameter to a point part of the way towards the textile outer diameter and returns to the textile inner diameter. In another embodiment, at least one the weft fibers traverses from the textile outer diameter to a point part of the way towards the textile inner diameter and returns to the textile outer diameter.

In another embodiment, the radial distance between adjacent circumferential warp fibers increases from the textile outer diameter to the textile inner diameter.

In another embodiment, the helical textile has a substantially uniform ratio of weft fiber volume fraction to hoop fiber volume fraction from the textile inner diameter to the textile outer diameter. In another embodiment, the ratio varies by no more than thirty percent from the textile inner diameter to the textile outer diameter.

DETAILED DESCRIPTION

One embodiment of the present invention is a warp knit helical textile having a repeating pattern of weft fibers of varying lengths such that the overall textile has a substantially uniform thickness and more consistent warp to weft fiber distribution from ID to OD. Warp knitting uses manufacturing methods to orient the fibers in layers that are not interlaced. Rather, warp and weft fibers are constructed in discrete layers, one above the other.

Figure 1:
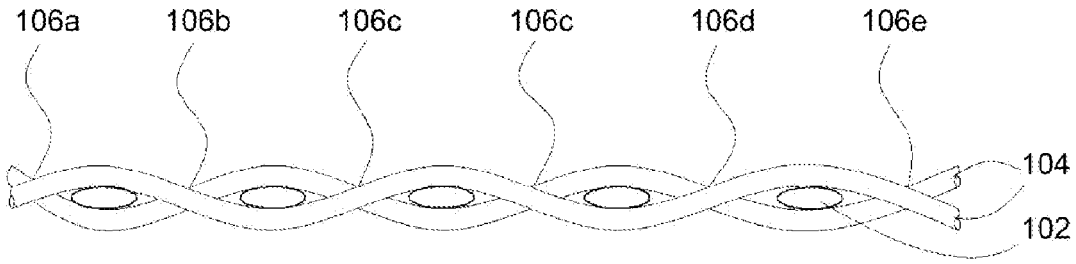
PRIOR ART Fig. 1
FIG. 1 is a side elevation of a textile of the prior art.
Figure 2:
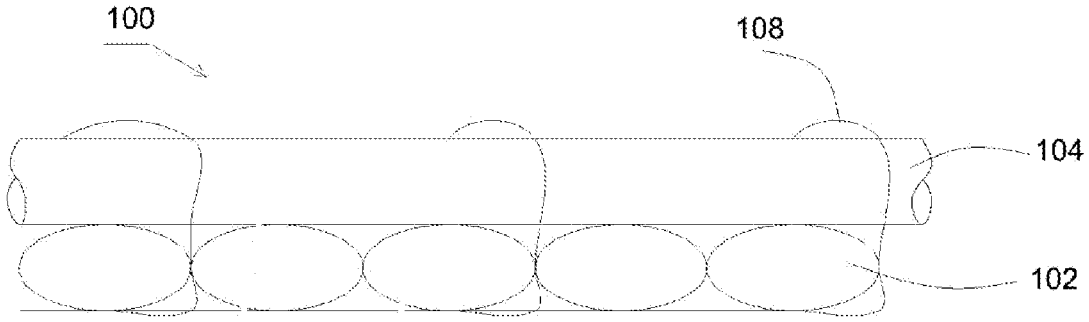
FIG. 2 is a side elevation of a textile according to the present invention.

The warp and weft fibers, in their respective layers, are straight, not crimped, and are parallel to adjacent fibers in the same layer. Turning to FIG. 2, warp fibers 102 and those next to it are shown in cross section, and are interpreted as coming out of the page. The warp fibers 102 are in the circumferential direction, and are circumferentially parallel to each other. The weft fibers 104 are in the radial direction, and are radially parallel to each other. Unlike the prior art, no interlacing between warp fiber layer and weft fiber layers are needed. The warp fibers 102 and weft fibers 104 are secured to each other or bound together with a third fiber direction. This third direction is inserted with knitted stitches 108. This third direction is not generally considered as a third reinforcing direction and is usually a non-reinforcing yarn type and in very low concentration compared to the warp and weft. The purpose of the knitted yarn is to hold the warp and weft layers together and to avoid the need to interlace the warp and weft. This third direction of yarn does not equate the resulting textile product to a three dimensional textile material since the resulting material described here is a single layer of knitted textile material. Contrast this to three dimensional weaving techniques that are used to manufacture multilayered textile materials.

The process of manufacturing the helical textile material utilizes modified warp knitting machinery. The modifications that are introduced are necessary to accommodate two issues: the take-up means to introduce the helical shape, and the weave design to accommodate the varying geometry of the textile structure from the inside diameter ("ID") to the outside diameter ("OD") of the helical material produced. In the present invention it is desired that the resulting material have an as constant as practical ratio of warp to weft fibers from ID to OD. This requires that the weft end count at the OD be higher than at the ID.

Figure 3:
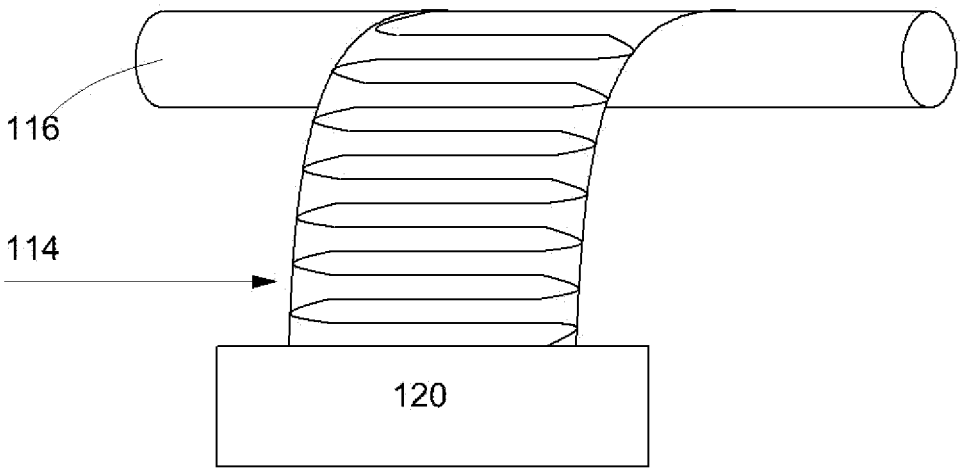
PRIOR ART Fig. 3
FIG. 3 is an orthogonal view of a take-up roll and textile of the prior art.

A warp knitting machine 120 of the prior art is shown in FIG. 3. The knitting machine 120 has a cylindrical take-up roll 116 and produces a straight woven textile 114. The warp knitting machine other than the take-up roll is shown as a black box in this drawing.

Figure 4:
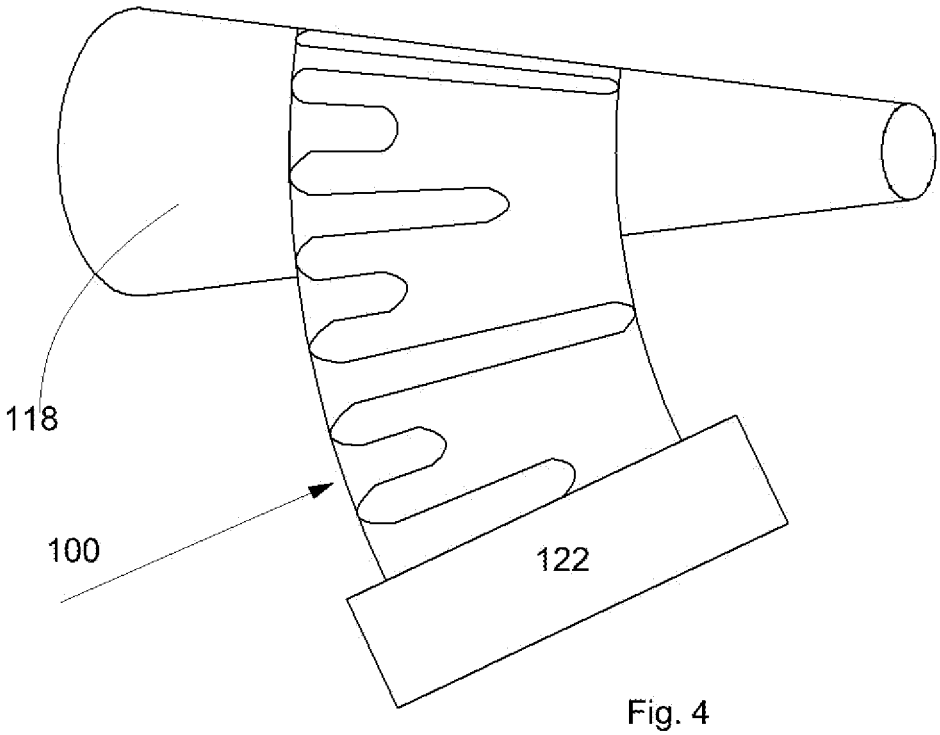
FIG. 4 is an orthogonal view of a take-up roll and textile of the present invention.

To make the helical textile 100 of the present invention, a warp knitting machine 122 is modified so that the cylindrical take-up rolls are replaced by conical take-up rolls 118 as shown in FIG. 4. The warp knitting machine is also shown as a black box in this drawing. The angle of the conical roll or rolls is designed to produce the desired ID and OD ratio of the resulting helical textile material 100. In this manner, the usual machine features necessary to adjust the take-up speed and such are maintained. A similar result is possible with a take-up mechanism that is a separate device from the knitting machine such that the material being knitted avoids the normal cylindrical take-up rolls. This separate device is controlled with mechanisms or electronic controls or both activated by features such as cams on the knitting machine.

Figure 5:
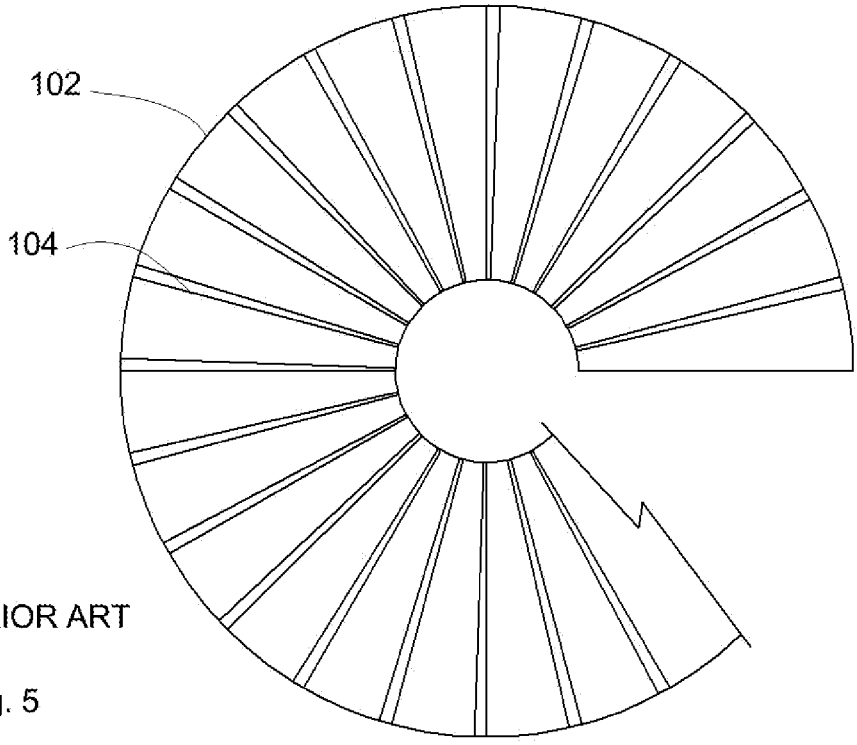
PRIOR ART Fig. 5
FIG. 5 is a plan view of a helical textile having a uniform length of weft fibers.

The ratio of warp to weft fibers will depend on the particular final application of the composite structure. Most applications envisioned will require an as uniform as practical ratio of warp to weft from ID to OD regardless of what that ratio is. This requires that not all weft (radial) fibers continue from OD to ID. For example, if we assume that the full width weft fiber length for a particular design was intended to be three inches, in a straight weave, all weft fibers would be three inches long. If in the same example but with a helical textile as shown in FIG. 5, and the weft fibers 104 are all three inches long, the spacing between adjacent weft fibers would be greater at the OD than at the ID. Therefore the weft fiber density near the ID would be greater than the OD and the thickness of the fabric near the ID would be greater than the OD. This would lead to non-uniform properties, which are undesirable.

Figure 6:
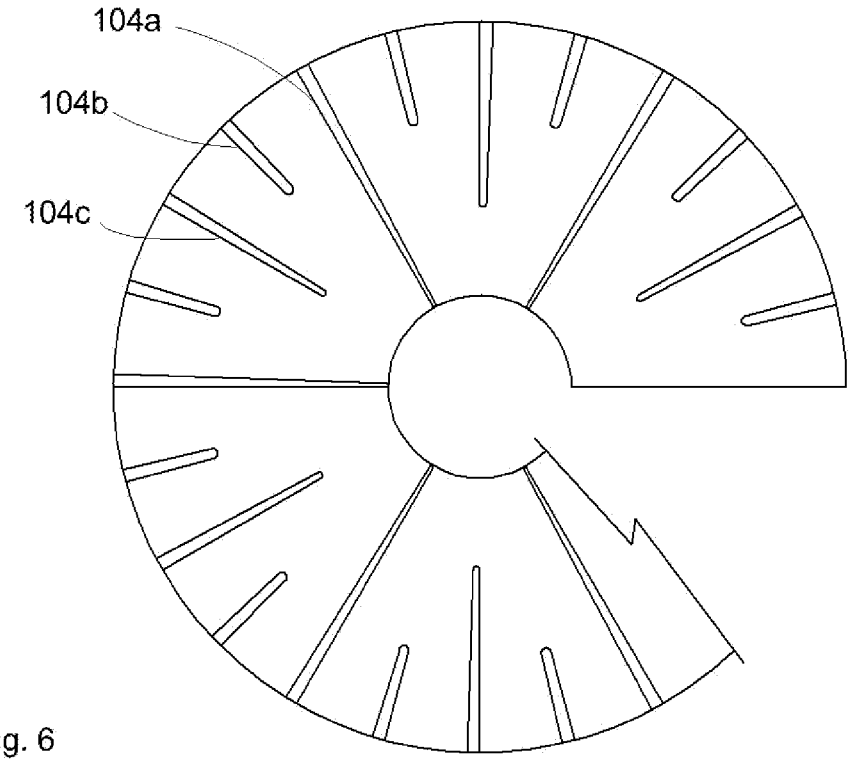
FIG. 6 is a plan view of a helical textile according to the present invention having uniform thickness.

This can be improved by introducing weft fibers 104 of less than three inch length, as shown in FIG. 6. The intent is to make the final textile material as uniform as practical from OD to ID. The weft fibers will have one end at the OD of the textile, and the other end will proceed to some predetermined location part way from the OD to ID and then terminate or return towards the OD. If individual weft fibers were inserted, then they would terminate. If a continuous weft fiber were inserted, then it would bend and return towards the OD.

In a helical textile, the repeating sequence of weft fiber insertions might be three inches 104*a*, one inch 104*b*, two inches 104*c*, one inch 104*b*, and finally three inches again 104*a*. This would allow more constant ratio of warp to weft from OD to ID. This also translates to a more constant thickness of the knitted material 100 across the width from ID to OD. It is understood that this is only an example of the different lengths of weft that can be used. A more uniform fabric can be made by increasing the number of different weft lengths, until it is no longer cost effective. The embodiment shown in FIG. 6 uses one weft insertion device.

Figure 7:
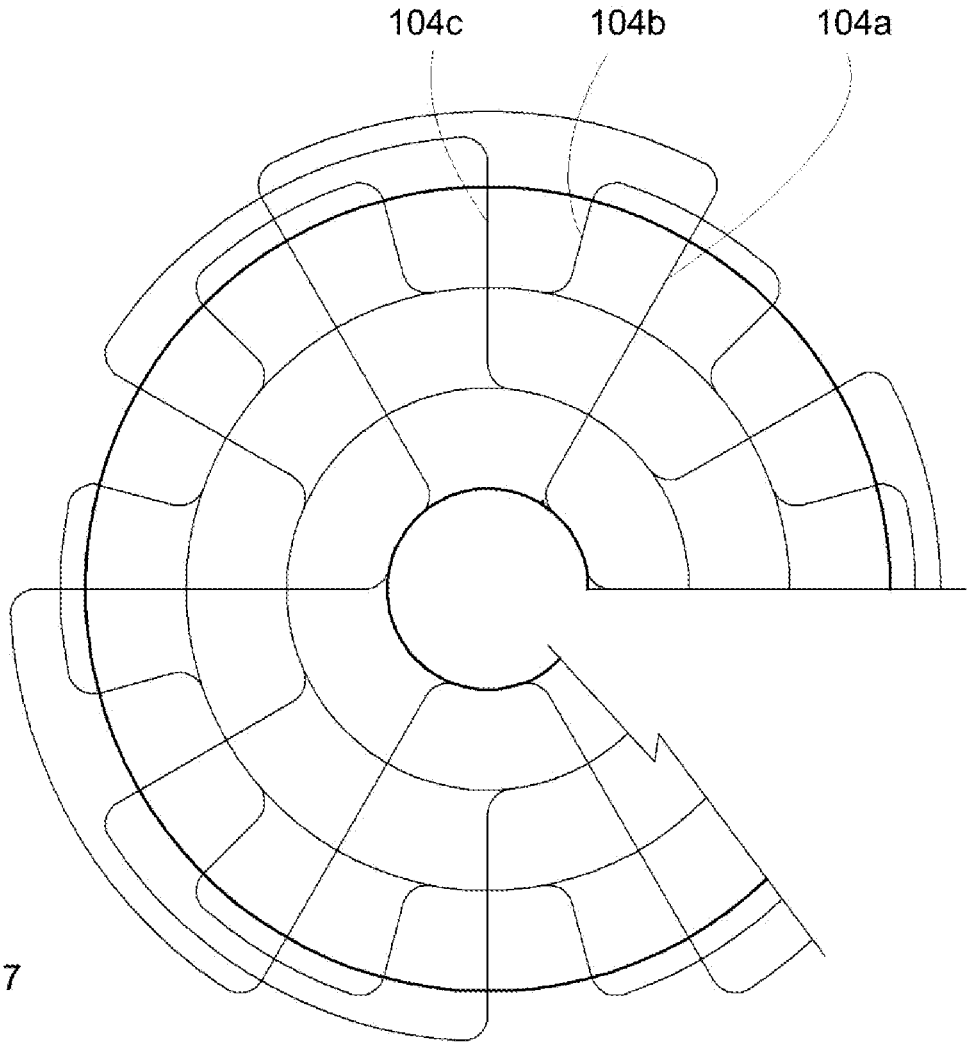
FIG. 7 is a plan view of another embodiment of a helical textile having a single weft yarn and is made using three weft insertion devices.

More complex patterns having a single weft yarn of different lengths instead of pairs is shown in FIG. 7. In this embodiment, three weft insertion devices are required.

The length of the weft insertion, also referred to as the shot or throw direction in knitting, can be controlled with cams, pins, knuckles, or electronically, depending on the style and age of the knitting machine used. The level of control generally available in all machines of this type is such that each weft insertion (shot or throw) can be tailored to be of different length. The combination, therefore, of variable length weft insertion and conical take-up will produce the material intended.

Figure 8:
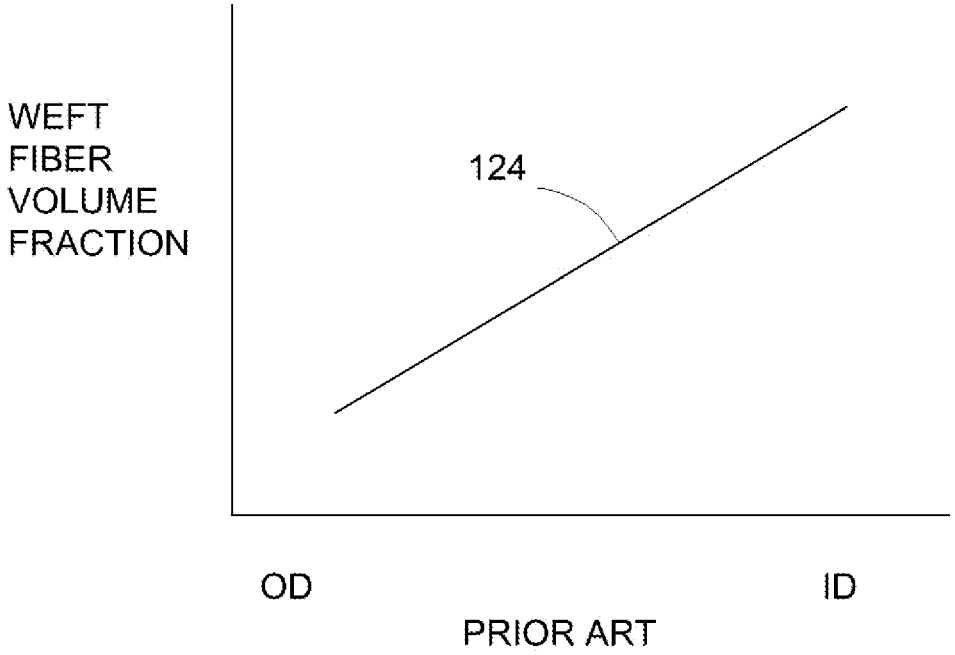
FIG. 8 is a graph of how the prior art weft volume fraction increases from OD to ID.
Figure 9:
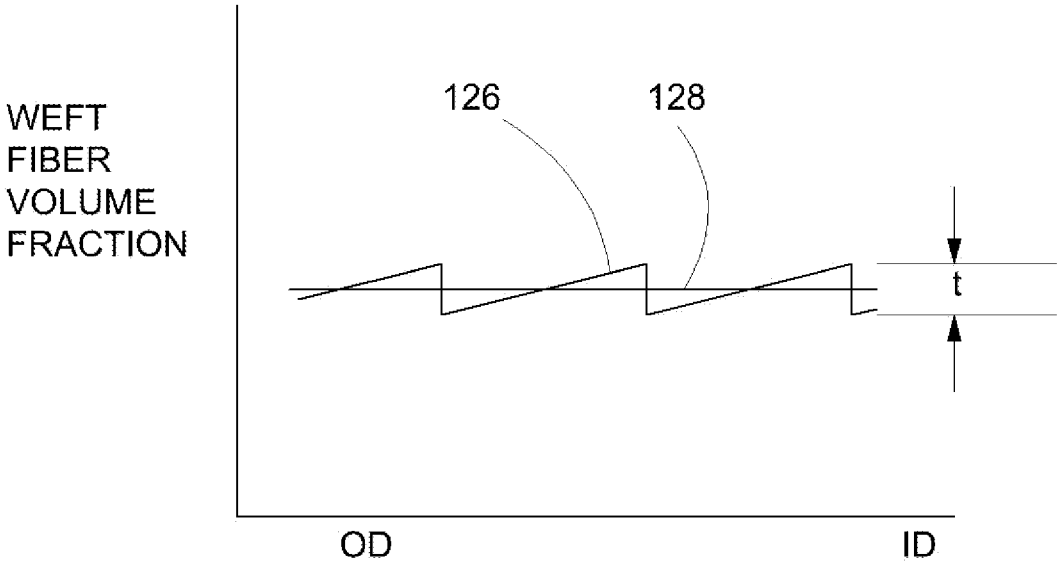
FIG. 9 is graph showing weft fiber volume fraction according to the present invention.

The helical fabric of the present invention has been said to have a "more constant" thickness than that of the prior art. The thickness of a single layer of fabric is not perfectly uniform or constant, but varies by the width of a weft fibers and insertion length. FIG. 8 is a graph that shows that the weft volume fraction 124 in the prior art increases from OD to ID. This increases the thickness. FIG. 9 shows that the weft volume fraction is more constant from the OD to the ID, and the thickness will be substantially more uniform.

FIG. 9 has a curve that represents weft fiber volume fraction from OD to ID 126. The curve 126 has three peaks that correspond to the use of weft fibers of three different lengths. The difference between the peaks and troughs is the thickness "t". The thickness "t" is not exactly the same as the thickness of a weft fiber, but it is related. The thickness "t" is also related to how closely the weft fibers are inserted together. The average thickness 128 is a flat line instead of a rising line like that in FIG. 8. As defined in the specification and claims, therefore, the term "substantially" uniform shall be construed to mean uniform to within the thickness "t".

Figure 10:
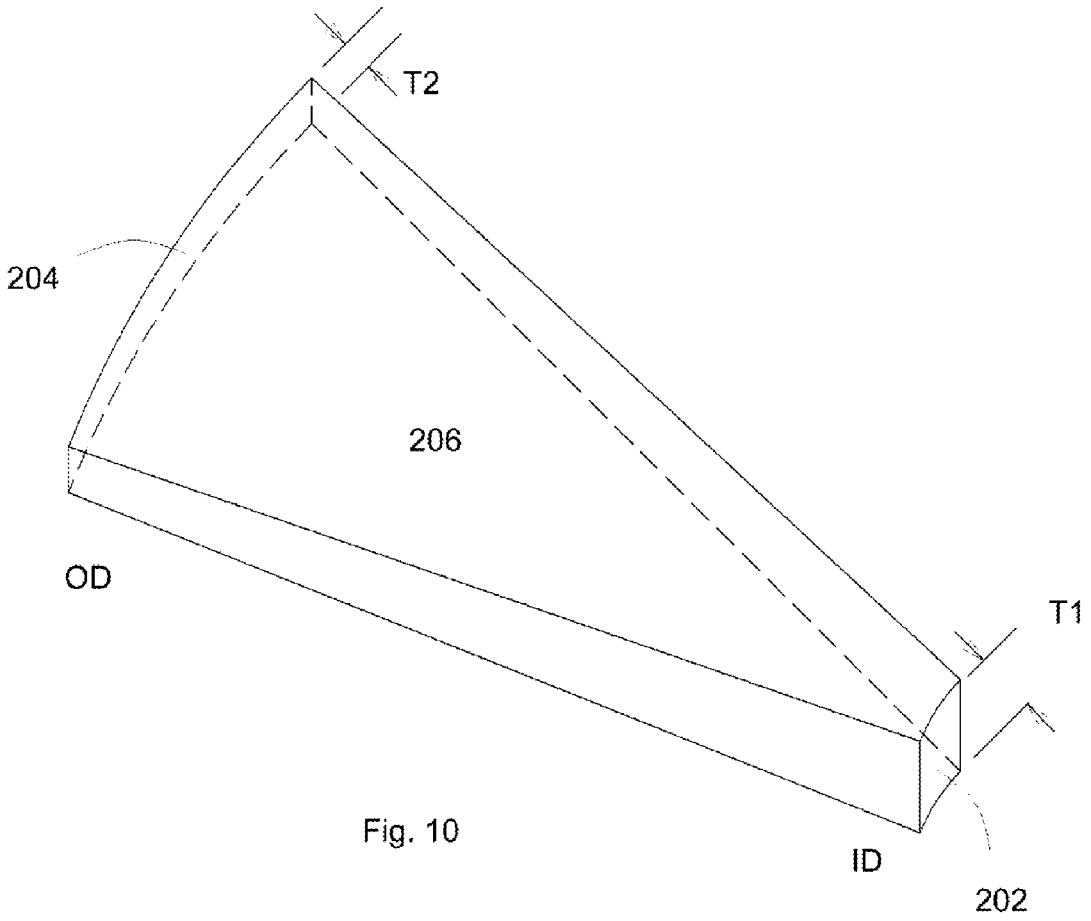
FIG. 10 is a perspective view of a weft section of non-uniform thickness.

There are other ways to form helical textiles having a substantially uniform thickness. FIG. 10 is a perspective view of a weft bundle 206 having uniform cross sectional area from the textile ID 202 to textile OD 204. The thickness T1 at the ID 202 is greater than the thickness T2 at the OD 204. The weft bundle width can be narrower at the ID 202 than at the OD 204 so that the cross sectional area can be constant along its length.

Figure 11:
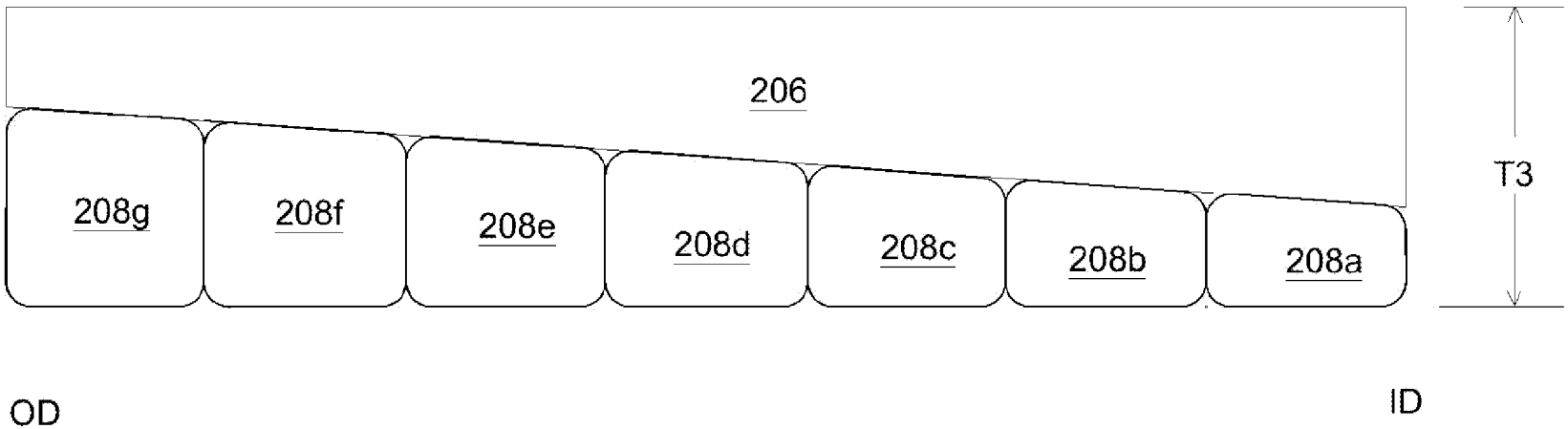
FIG. 11 is a cross section view of a textile having the weft section of FIG. 10 and warp fiber bundles having uniform width and varying height.

FIG. 11 is a cross sectional view of a helical textile showing the weft bundle 206 of FIG. 10 with progressively larger warp yarns 208*a* through 208*g* from ID to OD. Like the earlier embodiments, the warp and weft are not interlaced or crimped. The widths of warp bundles 208*a* through 208*g* are substantially constant, but their heights increase from textile ID to textile OD. Combined with the properties of the weft 206, the overall height of the textile T3 remains substantially constant. The larger warp yarns have a larger cross sectional area as shown. This embodiment is very beneficial in that it permits the manufacturer to use yarn denier or filament counts that are already available.

Figure 12:
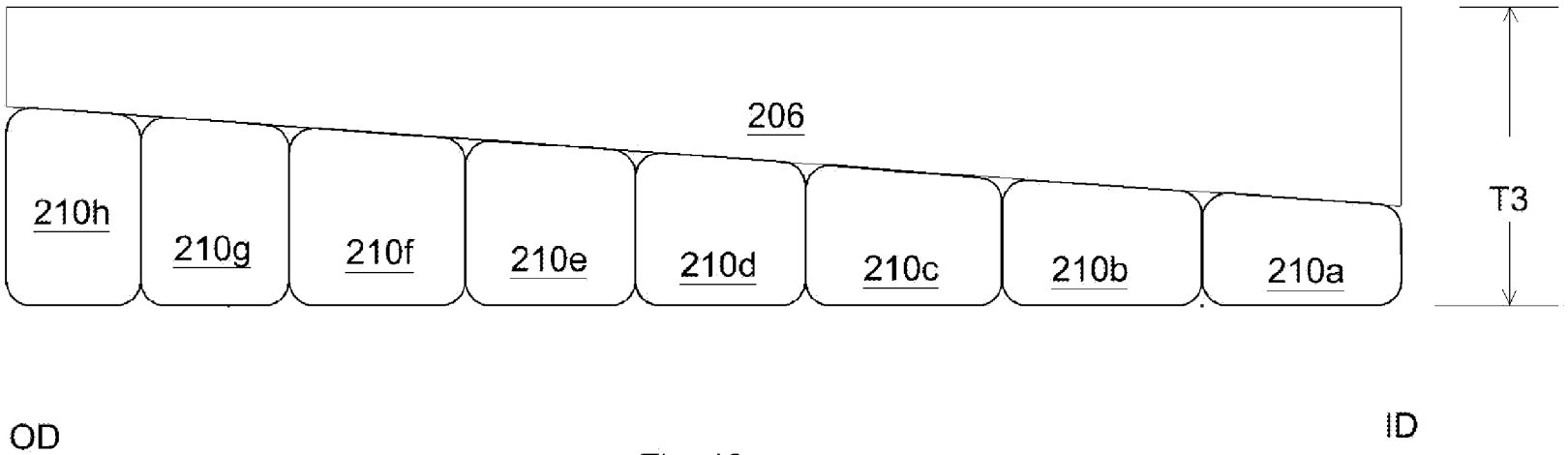
FIG. 12 is a cross section view of a textile having the weft section of FIG. 10 and warp fiber bundles having width varying inversely with height.

FIG. 12 is a cross sectional view similar to FIG. 11, except that the warp bundles 210*a* through 210*h* are the same size and have the same cross sectional area. They are merely spaced closer together toward the OD than the ID. This makes the width of the warp bundles 210*a* through 210*h* decrease from ID to OD, but makes the height increase because the cross sectional area of the warp bundles is constant. This is another embodiment that results in a helical textile having a substantially constant thickness T3.

Figure 13:
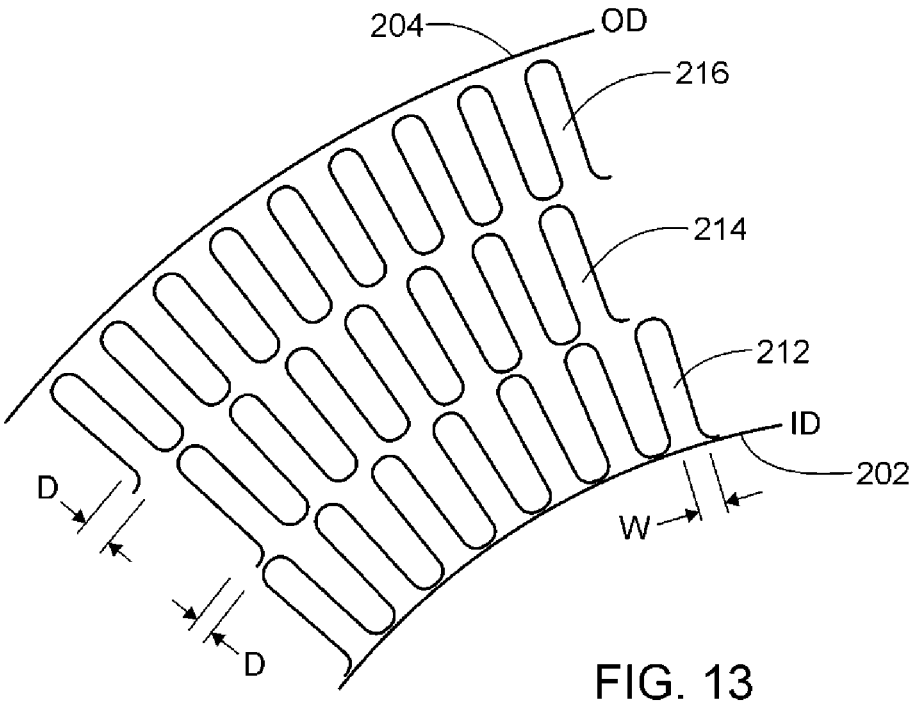
FIG. 13 is a plan view of a weft fiber layer embodiment having three weft fiber bundles at discreet radial distances between the textile ID and OD, and where the spacing between the bundles is constant.
Figure 14:
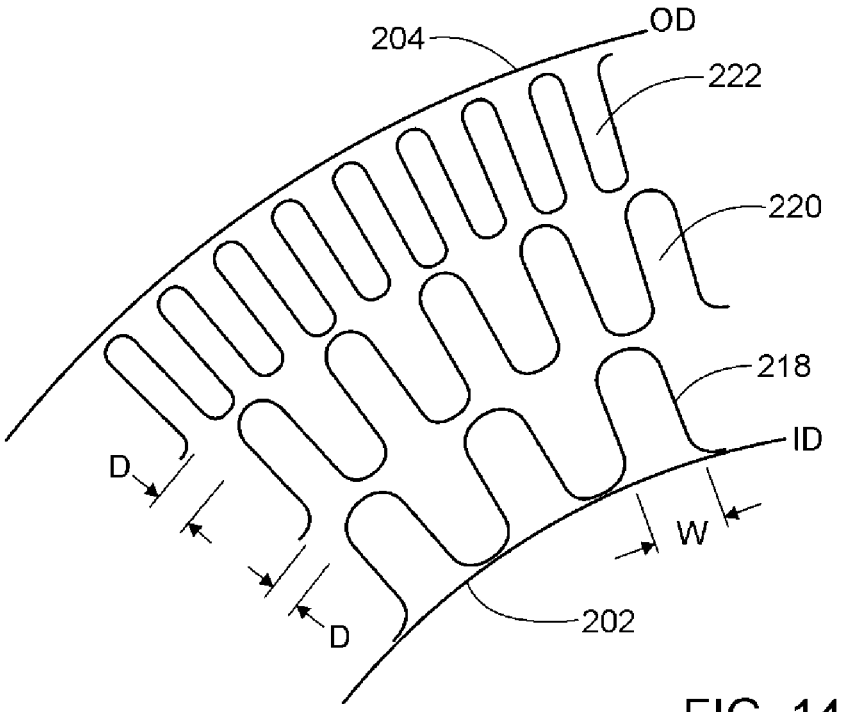
FIG. 14 is a plan view of a weft fiber layer embodiment having three weft fiber bundles at discreet radial distances between the textile ID and OD, and where the spacing between the bundles decreases from OD to ID.

FIG. 13 is a plan view of a weft fiber layer embodiment having three weft fiber bundles 212, 214, 216 at discreet radial distances between the textile ID 202 and OD 204. The radial spacing "w" between the bundles is constant. As used herein, a "bundle" is a continuous fiber or group of fibers that is shown going back in forth in an "S" shape. In this embodiment generally shown in FIGS. 13 and 14, no weft bundles traverse entirely from ID 202 to OD 204. FIGS. 13 and 14 show three bundles, but two or more could be used. In FIG. 14, the bundles are numbered 218, 220, and 222 from ID to OD.

The bundle closest to the OD 216 has a greater concentration of weft yarn than the mid-wall bundle 214, and the mid-wall bundle 214 has a greater concentration than the bundle closest to the ID 212. This can be done in two ways: 1) use the same or similar bundle spacing but use larger yarns in the weft at the OD 216 versus mid-wall 214 versus ID 212, such as that shown in FIG. 13, or 2) turning to FIG. 14, use the same yarn bundle size in each bundle but use a closer bundle spacing "w" at the OD 222 versus mid-wall 220 versus the ID 218.

In FIG. 13 the weft bundles 212, 214, 216 can be separated by a radial distance "D" or they can actually overlap, as design issues dictate. In FIG. 14 the weft bundles 218, 220, 222 can also be separated by a radial distance "D" or they can actually overlap, as design issues dictate.

One benefit of using different yarn denier or filament counts is that one can use stock that is at hand. This can be a great cost savings.

The features shown in FIGS. 13 and 14 can also be used with either or both the warp modification options shown in FIGS. 11 and 12, namely, constant warp yarn spacing from OD to ID but change the yarn bundle size/cross sectional area, or use a constant yarn bundle size from OD to ID but change the spacing between adjacent warp yarn bundles. In other words, warp yarns are spaced closer together as one progresses from ID to OD.

As described above, some embodiments of a helical textile are constructed where a uniform thickness from textile ID to OD is achieved while also introducing radial and hoop fibers without crimp. However, a need exists in applications where improved shear strength is required in a plane defined by the weft fibers and hoop fibers. For example, in a composite clutch or brake application, lugs are often machined into a portion of the disk adjacent the inner edge or outer edge of the disk. Mechanical hardware may then contact the lugs to affect the engagement of the clutch or brake. The loads introduced on the lugs are primarily shear loads and are not best accommodated with fibers extending in a true radial direction in the composite structure.

In another example, a clutch plate has "fingers" machined into the inner part of the clutch disk. These fingers act like springs to apply a load between the clutch plate and the plate it engages. Here, the load on the fingers is flexure rather than shear and is best accommodated with weft fibers oriented in a near-radial orientation. The width of the fingers in a near-radial orientation are more narrow at the inner diameter of the clutch disk and increase in width as they move towards the outer diameter of the clutch disk. Being able to orient weft fibers approximately parallel to the edges of the fingers results in a more efficient structure as compared with weft fibers oriented in a true-radial direction. In one embodiment, true-radial weft fibers that are positioned close to edges of the fingers terminate short of the ends of the fingers, but weft fibers parallel to the fingers preferably do not terminate short of the ends of the fingers.

Figure 15:
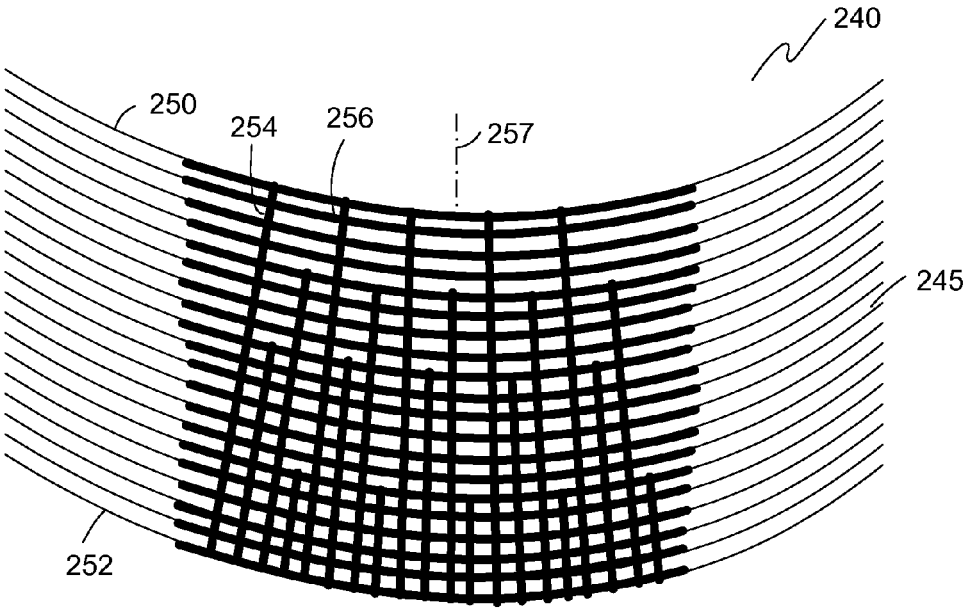
FIG. 15 is a plan view of an embodiment of a helical textile showing circumferential warp fibers and radial weft fibers of different lengths.

FIG. 15 shows a top view of one embodiment of a helical textile 240 where each weft fiber 254 has a true radial orientation since weft fiber 254 extends substantially perpendicular to the ID edge 250 and to the OD edge 252 of helical textile 240. In other words, each weft fiber 254 has a true radial orientation and defines an angle of zero degrees with respect to a radial axis 257. Multiple weft fibers are inserted simultaneously where weft fibers have varying lengths and are aligned in a true radial orientation.

In other embodiments of helical textiles, weft fibers are inserted in an orientation other than a true radial orientation. Lines 245 represent potential fiber locations or circumferential warp fibers 256 in helical textile 240. In the helical textile embodiments described below with reference to FIGS. 16-22, yarn movements are shown as a jagged line representing actual machine motions. In practice, the yarns take a smooth path from one machine cycle position to the next.

Figure 16:
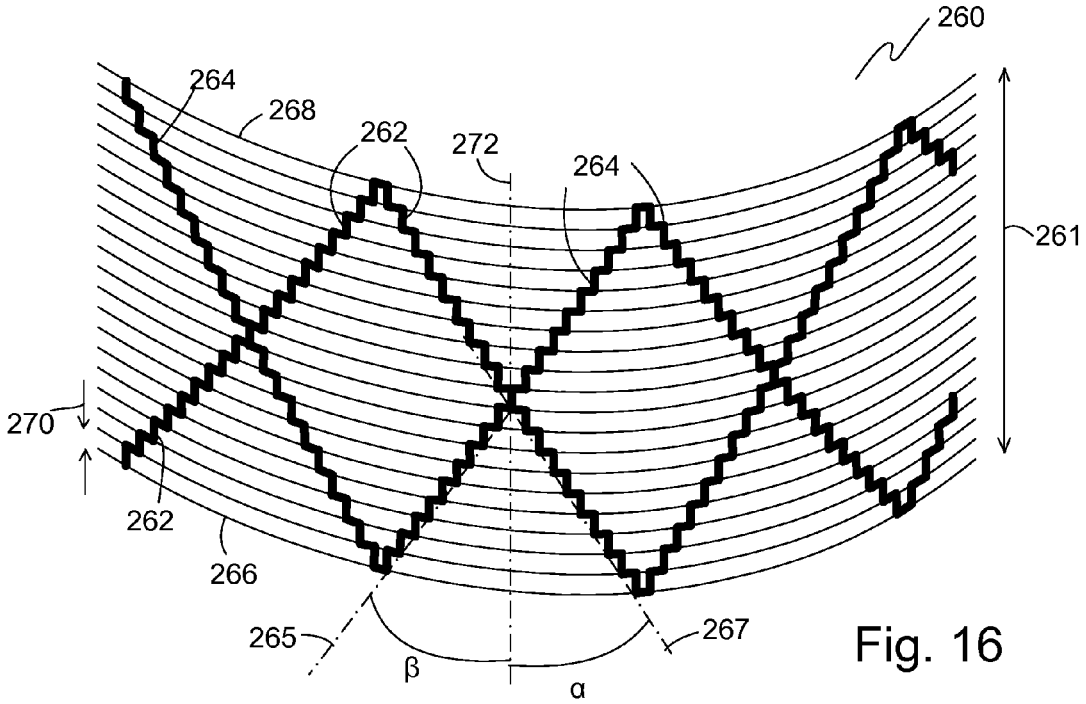
FIG. 16 is plan view of an embodiment of a helical textile with biased radial weft fibers inserted with orientations other than a true radial orientation.

Referring now to FIG. 16, a top view of a helical textile 260 shows a basic embodiment of the textile with biased weft fibers 262, 264 inserted simultaneously at orientations other than a true radial orientation. A first weft feeder inserts weft fiber 262; a second weft feeder inserts weft fiber 264. Weft fiber 262 starts at the OD position or edge 266 and moves one incremental step 270 (one unit cell) towards the ID position or edge 268 with each machine cycle. As such, the "radial" weft fiber 262 is laid down along a weft fiber axis 267 intersecting a true radial axis 272 at a predefined bias angle $\alpha$. Radial axis 272 extends perpendicularly to OD edge 266 of helical textile 260. Similarly, weft fiber 264 is laid down along weft fiber axis 265 intersecting true radial axis 272 at a predefined bias angle $\beta$. In one embodiment, angle $\alpha$ and angle $\beta$ are preferably about forty-five degrees. In other embodiments, angle $\alpha$ and angle $\beta$ are between about thirty and about sixty degrees. In other embodiments, it is acceptable for angle $\alpha$ and angle $\beta$ to be between about ten and about eighty degrees. In this illustration, a second weft feeder inserts weft fiber 264 out of phase with weft fiber 262 inserted by the first weft feeder. Weft fibers 262, 264 do not need to be inserted exactly out of phase.

The machine's design flexibility allows weft feeders to advance more than one unit cell with each machine cycle. It also allows a weft feeder to hesitate at a location for one or more machine cycles. With these two features, angles $\alpha$, $\beta$ can be tailored for weft fibers 262, 264, respectively. For example, if the first weft feeder advances radially two unit cells for each machine cycle, the resultant yarn angle $\alpha$ is smaller and weft fiber 262 is oriented closer to a true radial position. Here, one unit cell is defined by a single increment of a yarn feeder in radial and circumferential directions of one machine cycle. Lines 261 extend between each row of unit cells. On the other hand, if the first weft feeder advances to a second unit cell site and then hesitates for one or more machine cycles in a repeating fashion, weft fiber 262 is laid down at angle $\alpha$ that is greater and where weft fiber 262 is closer to a hoop orientation.

Figure 17:
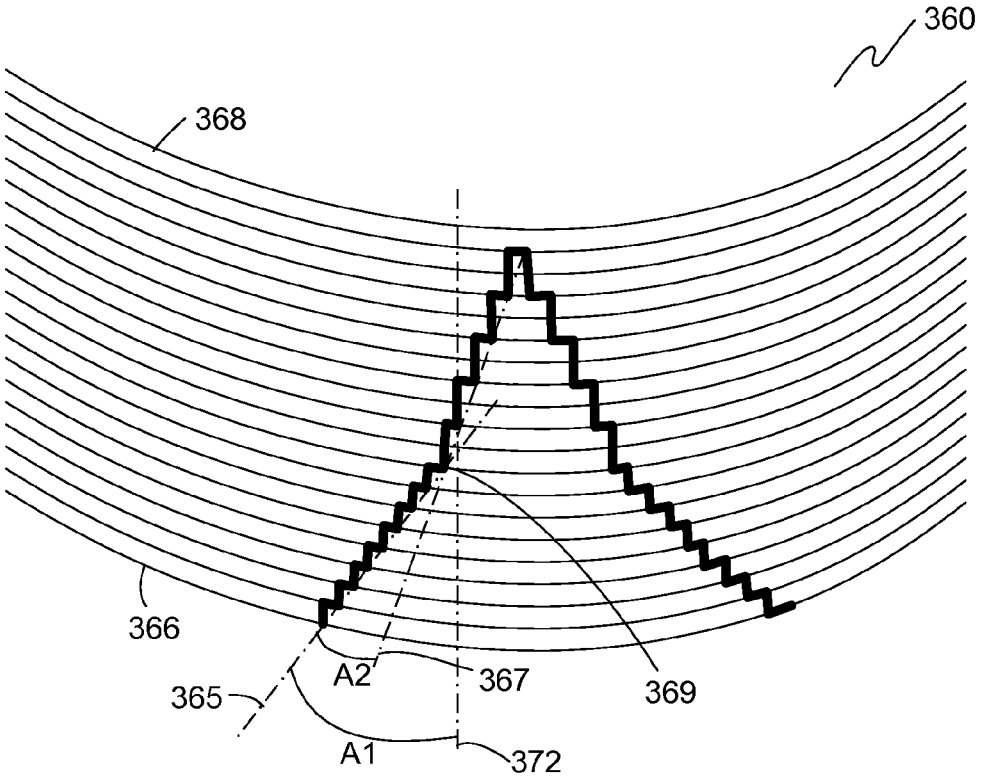
FIG. 17 is a plan view of an embodiment of a helical textile showing a biased radial weft fiber inserted along a first axis and then along a second axis.

Referring now to FIG. 17, another embodiment of a helical textile 360 has a weft fiber 365 laid down at more than one bias angle with respect to true radial axis 372 as the weft fiber traverses from OD position 366 towards ID position 368. Here, the weft fiber feeder advances one site per machine cycle, then switches at position 369 to radially advance two sites per machine cycle. The result is a first weft fiber axis 365 (with larger bias angle A1) and a second weft fiber axis 367 (with a smaller bias angle A2). In another embodiment, for example, the weft fiber feeder advances multiple sites for one or more machine cycles and then hesitates for one or more machine cycles as it makes its way from OD to ID. By repeating such cycles, weft fiber 362 is laid down with multiple bias angles A1, A2 with respect to radial axis 372.

Figure 18:
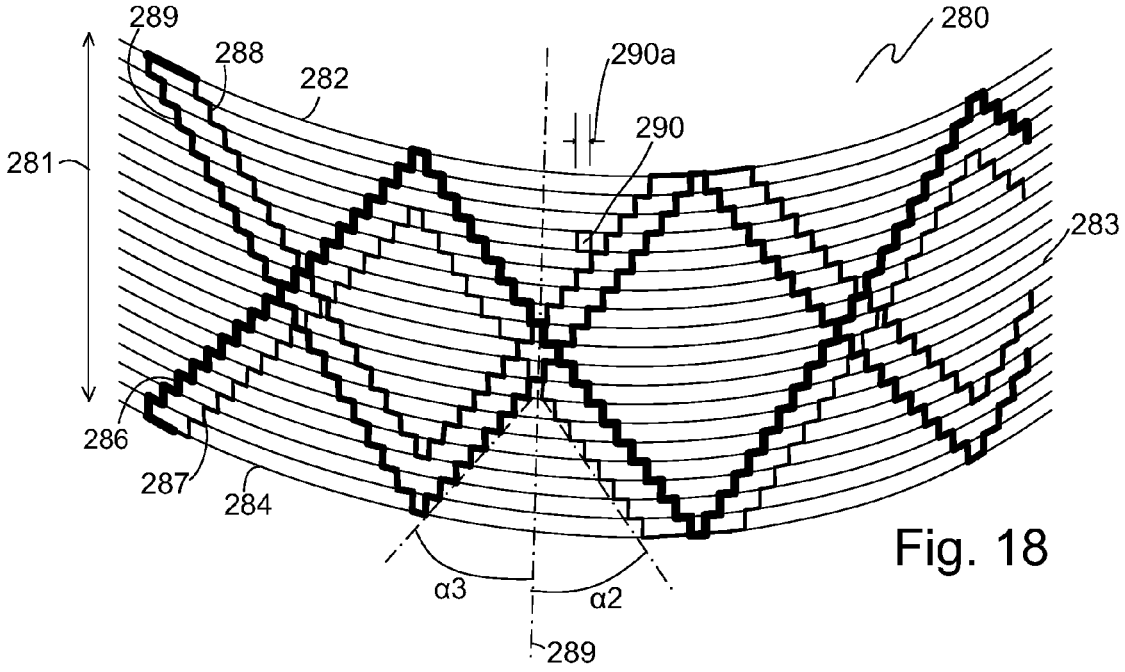
FIG. 18 is a plan view of an embodiment of a helical textile made with multiple weft fiber feeder tubes and showing weft fibers extending across the textile between different radial positions.

In yet another embodiment of the invention, each weft insertion device has multiple yarn feeder tubes. Having multiple weft fiber feeders provides a more uniform surface of off-axis weft bias fiber content. FIG. 18 illustrates an example of a helical textile 280 having an ID edge 282 and an OD edge 284 made with an insertion device having two weft insertion devices each having two weft feeder tubes. Some weft fibers extend across the full radial width 281 while others extend partially across the radial width 281. Helical textile 280 has unit cells (e.g., unit cell 290) separated radially by position lines 283. Weft bias fibers 286, 287, 288, 289 preferably travel the circumferential length 290*a* of one unit cell 290 for each radial increment as the fibers traverse between ID edge 282 and OD edge 284. Weft bias fibers 286, 287 begin at OD edge 284 and traverse towards ID edge 282 and back repeatedly at an angle $\alpha$2 between weft bias fibers 286, 287 and radial axis 289; weft bias fibers 288, 289 begin at ID edge 282 and traverse towards OD edge 284 and back repeatedly at an angle $\alpha$3 between weft bias fibers 288, 289 and radial axis 289. As illustrated in FIG. 18, $\alpha$2 and $\alpha$3 are approximately equal, but $\alpha$2 may differ from $\alpha$3 in other embodiments.

In contrast to helical textile 260 shown in FIG. 16, where weft fibers 262, 264 traverse the entire width 261 of helical textile 260 between OD 266 and ID 268, it is also possible, and in some cases desirable, for a weft fiber to traverse from OD position 266 only part of the distance to ID position 268 and then return to OD position 266. Similarly, a weft fiber may traverse from ID position 268 only part of the distance to OD position 266 and then return to ID position 268. As illustrated in FIG. 18, weft fiber 286 traverses helical textile 280 from OD edge 284 to ID edge 282. Weft fiber 287 is radially offset from weft fiber 286 by three unit cells and traverses to a position that is three unit cells away from ID edge 282. As such, weft fiber 287 does not traverse the full radial width 281 of helical textile 280. Although weft fiber 287 starts at OD edge 284, it traverses only part way towards ID edge 282 due to being offset from weft fiber 286. Similarly, weft fiber 288 traverses only part way from ID edge 282 towards OD edge 284.

Figure 19:
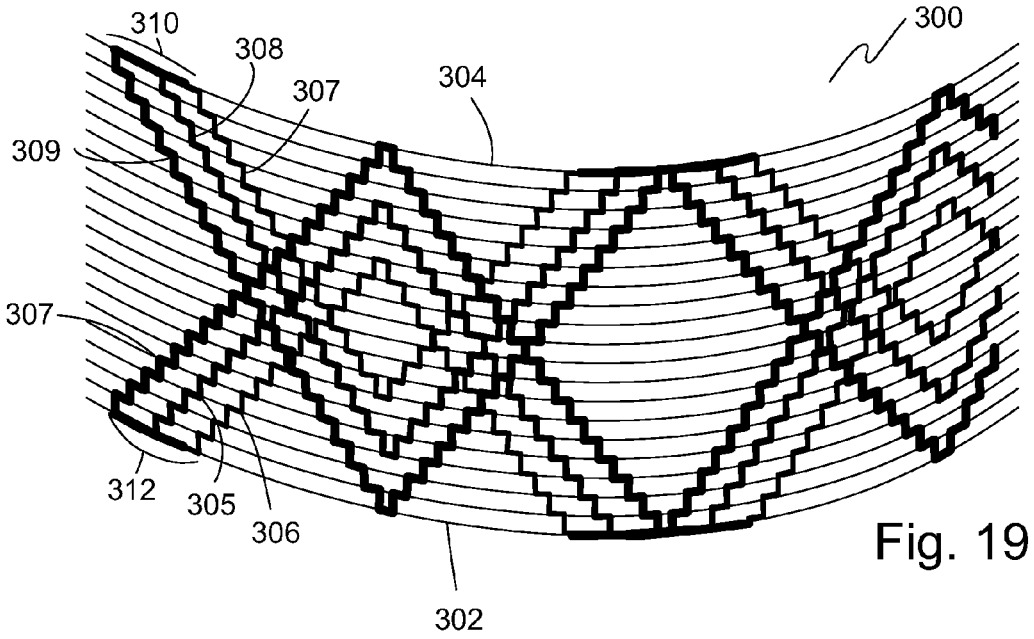
FIG. 19 is a plan view of an embodiment of a helical textile having weft fibers radially offset from one another.

Referring now to FIG. 19, there is shown a helical textile 300 made with two weft insertion devices each having three weft feeder tubes. Textile 300 has two sets 310, 312 of weft bias yarns or fibers, each of which includes three weft fibers that, for example, are offset from one another by three positions. In some embodiments, feeder tubes occupy each adjacent unit cell on one or more weft feeder devices. Fiber set 310 includes weft fibers 307, 308, and 309; fiber set 312 includes weft fibers 305, 306, and 307. Weft fibers 305, 306 that start at OD edge 302 and traverse only part way towards ID edge 304 before returning to OD edge 302. Similarly, weft fibers 307, 308 start at ID edge 304 and traverse only part way towards OD edge 302 before returning back to ID edge 304. In another embodiment, none of the weft bias yarns run entirely from OD edge 302 to ID edge 304. Weft bias fibers define a chevron-type pattern similar to fiber set 312 and/or fiber set 310 that provides bias yarn coverage across the entire warp-weft plane of textile 300.

Figure 20:
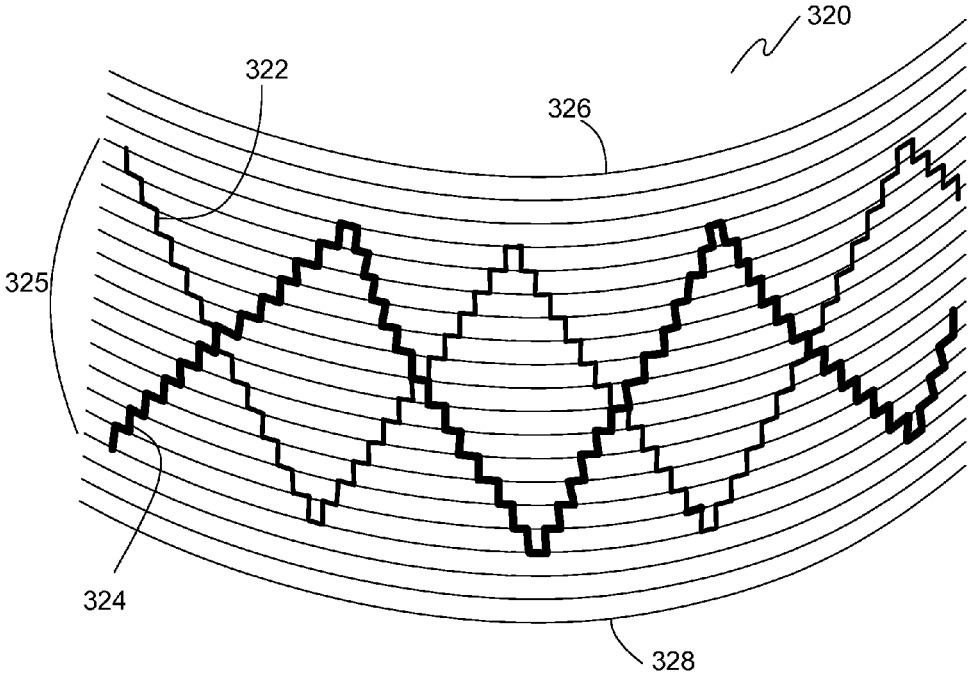
FIG. 20 is a plan view of an embodiment of a helical textile with biased weft fibers inserted in a weft region radially that is narrower than the textile width.

Referring now to FIG. 20, there is shown another embodiment of a helical textile 320 with off-axis radial-type fibers 322, 324 inserted in a weft region 325 of helical textile 320. Weft region 325 is approximately centered between ID edge 326 and OD edge 328. Weft region 325 in other embodiments is not centered between ID edge 326 and OD edge 328. In some embodiments, weft region 325 extends from either ID edge 326 or OD edge 328 to a radius between ID edge 326 and OD edge 328.

Figure 21:
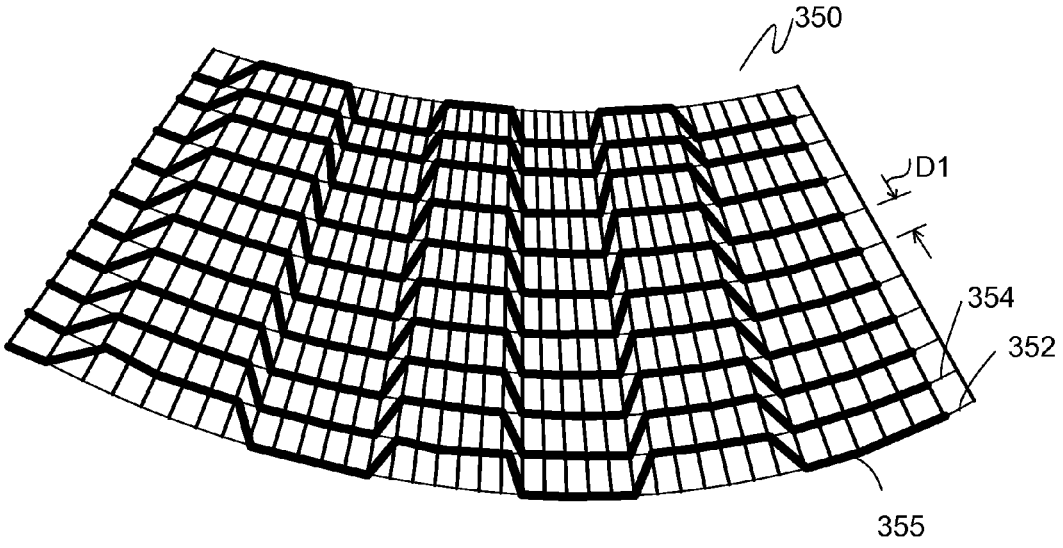
FIG. 21 is a plan view of an embodiment of a helical textile with circumferential warp fibers that change between a first hoop position and a second hoop position.
Figure 22:
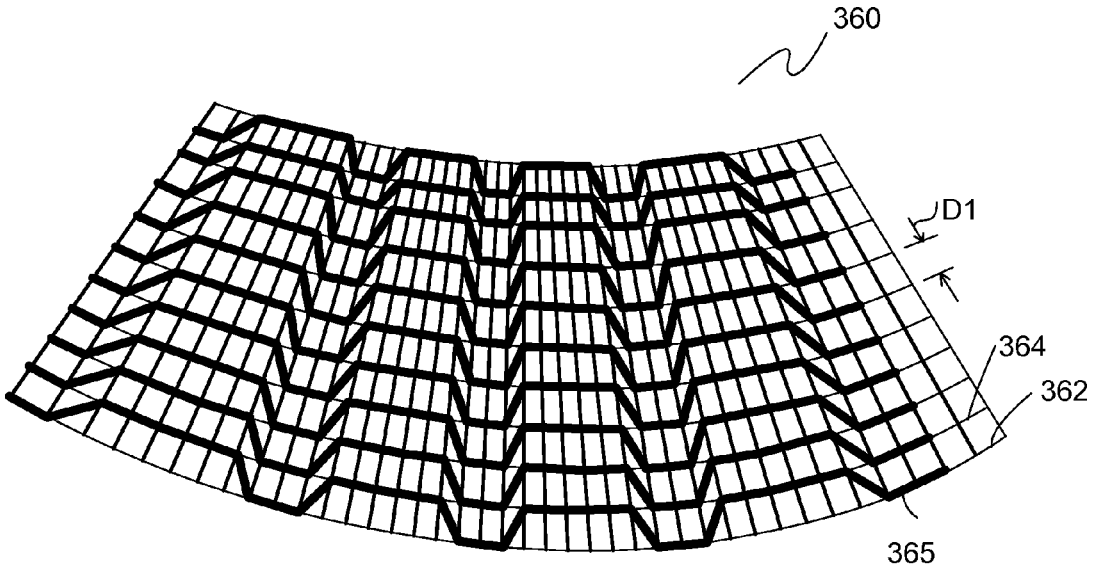
FIG. 22 is a plan view of another embodiment of a helical textile with circumferential warp fibers that change between a first hoop position and a second hoop position.

Referring now to FIGS. 21-22, additional embodiments of helical textiles 350, 360 are shown. Helical textile 350 has multiple out-of-plane hoop yarns 355 separated by a radial distance D1; helical textile 360 has multiple out-of-plane hoop yarns 365 also separated by radial distance D1. Hoop yarns 355, 365 do not remain in true hoop positions. Instead, hoop yarns 355, 365 change from a first (e.g., outer) hoop position 352 to an adjacent second (e.g., inner) hoop position 354 and return to the first hoop position 352 after a predetermined number of machine cycles.

In some embodiments, hoop yarns 355, 365 return to first hoop position 352 or change to a third location in a regular or irregular repeating sequence. For example, hoop yarns 355 change positions every five machine cycles. In another example, hoop yarns 365 change or alternate between a first hoop position 362 and a second hoop position 364, remaining at the second position 364 for five machine cycles. Hoop yarns 365 then return to first hoop position 364 for two machine cycles. First hoop position 362 and second hoop position 364 are preferably adjacent hoop positions, but may be separated by one or more intermediate hoop positions.

Figure 23:
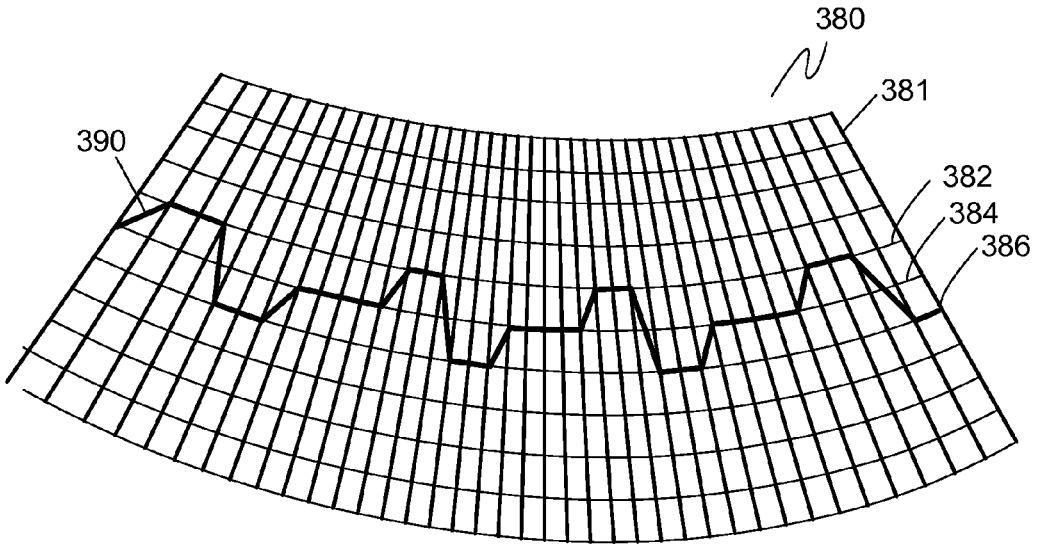
FIG. 23 is a plan view of another embodiment of a helical textile with circumferential warp fibers that change between first, second, and third hoop positions.

As illustrated in FIG. 23, a grid 381 shows possible yarn positions for a portion of a helical textile 380. A single hoop yarn 390 represents a path taken by all hoop yarns of textile 380. Hoop yarn 390 changes between a first hoop position 382, a second hoop position 384, and a third hoop position 386. Hoop yarn 390 may change between multiple such positions in a regular or irregular repeating pattern.

In the helical textile embodiments described with reference to FIGS. 16-23, warp fibers and weft fibers are secured with knitted chain stitches, where the knitted chain stitches are preferably knitted in a third fiber direction within the weft insertion region. These embodiments also may incorporate one or more options to achieve a helical textile with uniform thickness as described above with other helical textile embodiments. One option is to vary the size of hoop yarns (e.g. larger towards the OD) in order to make the thickness of the fabric layer more uniform. Another option is to vary the size of yarn bundles in the weft bias yarns in adjacent weft feeder tubes to achieve a more uniform thickness from textile ID to textile OD.

In textile 300 of FIG. 19, for example, the size of the weft yarn bundles could progressively increase towards the textile OD edge 302. Another feature of textile 300 is that the number of yarn sites that reach textile ID edge 304 can be varied so that textile 300 has more yarn sites towards OD edge 302 than at the ID edge 304 with the result of balancing the textile thickness. Any or all of these features can be implemented individually or in combination resulting in a high degree of design flexibility Weft fibers may vary in thickness from ID to OD and may have varying lengths.

All of the above fiber architecture options can be incorporated in combination with or without hoop fibers. It is also possible and in most cases desirable to maintain uniform textile thickness across the width between ID and OD. This can be accomplished in multiple ways, such as altering the yarn denier from OD to ID. For example, larger denier yarns are used towards the OD position 266 and smaller denier yarns are used towards ID position 268 on the off-axis weft feeders. It is also possible to change the spacing between adjacent yarn feeder tubes on the same weft insertion device. For example the feeders could be spaced closer at or near an OD position and further apart at or near an ID position. The radial distance between hoop yarns or warp fibers may also be varied between textile ID and textile OD. For example, uniform denier hoop yarns are radially closer together towards the textile OD and radially farther apart towards the textile ID.

In addition to having uniform textile thickness, some embodiments of the helical textile of the present invention also have a more uniform ratio of weft fiber volume fraction to hoop fiber volume fraction from the textile inner diameter to the textile outer diameter. Textile thickness uniformity can be affected by the total fiber volume fraction of the weave and by the volume fraction distribution or weft and hoop fibers. The total fiber volume fraction is the percentage of the total volume of textile (e.g. length×width×thickness) occupied by fibers within that volume. In some embodiments, the total fiber volume is between about fifty and sixty percent per unit volume of helical textile. That is, about fifty to sixty percent of the total fabric volume is textile fibers and the balance is air or voids. In one embodiment, a helical textile has a volume fraction of weft fibers that is about twice the volume fraction of hoop fibers per unit volume of the helical textile. In one embodiment, the total fiber volume fraction varies by no more than 30% from the textile inner diameter to the textile outer diameter. In another embodiment, the total fiber volume varies by no more than 20% across the textile width. In yet another embodiment, total fiber volume fraction varies by no more than 15% across the textile width, such as +13%/−8%. In one embodiment, the ratio of weft fiber volume to hoop fiber volume fraction varies by no more than 30% from the textile inner diameter to the textile outer diameter. For example, one textile has a ratio of weft fiber volume fraction to hoop fiber volume fraction that varies about +22%/−10% across the textile width. In other embodiments, the ratio varies by no more than 20% across the textile width.

The volume fraction ratio between weft fibers and hoop fibers is easier to determine when all the weft fibers are true radials and all the hoops are true hoops. When weft fibers are comprised of weft bias yarns, in whole or in part, then the fiber angles of the weft bias yarns are resolved into true hoop and true radial components and then the ratio of weft fiber volume to hoop fiber volume is calculated. For example, a weft bias fiber with a bias angle of forty-five degrees would contribute in equal parts to each of the weft fiber volume fraction and the hoop fiber volume fraction.

Typical applications of a textile according to the present invention would use multiple overlapping layers of helical textile i.e. a coil without cuts and splices. Another application might cut 360 degree pieces and then stack them to achieve multiple layers, alternating the position of the cut and splice.

The textile can be used to reinforce composite structures, or it could be used as a textile for non-composite applications, such as for a circular gasket. The fiber types that can be used include, without limitation, carbon, graphite, glass, and ceramic.

In use, having bias radial weft fibers that do not extend the full radial width of the helical textile is a feature that allows for improved design flexibility. For example, weft feeders near the textile OD can feed yarns that are larger (i.e., have a higher denier) than feeders closer to the textile ID. This is not possible with designs where all the radial weft fibers travel fully from textile ID to textile OD, regardless of whether they are orientated in a true radial direction or oriented at a bias angle. Another advantage of the present invention is that some feeders need not travel all the way to the textile ID, which allows the ability to balance fiber volume, and therefore textile thickness, from textile OD to textile ID.

A further advantage of the present invention is that textile machines can operate at more machine cycles per minute if the throw of the weft fibers is shorter. This is why narrow fabric weaving machines operate at much higher speeds than wide fabric looms. In examples described above, the throw of an individual weft feeder is relatively short, such as one, two, or three unit cells, and multiple weft fibers can be fed simultaneously. The result of these options is higher throughput as measured in yards of fabric per hour or weight of fabric per hour. It is advantageous to be able to produce unique fabric architectures while maintaining or improving manufacturing costs.

The present invention is capable of producing fabric with multiple layers of yarns that are not interlaced, but instead are bound together with knitted stitches. One embodiment of a layered textile has five layers of yarns or fibers. The five fabric layers can have of any combination of (1) fibers with a true radial orientation and of full or varying length, (2) weft bias yarns, (3) true hoop yarns, or (4) out of plane hoop yarns. For example, one embodiment of a helical textile has a textile construction with only bias yarns and knitted stitches—that is, the textile has no true radial fibers and no true hoop fibers.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A helical textile having a substantially uniform thickness comprising:

a plurality of circumferential warp fibers defining a radial textile width from a textile inner diameter to a textile outer diameter, the plurality of circumferential warp fibers extending substantially in a first fiber direction;

a plurality of weft fibers inserted in a weft region between the textile inner diameter and the textile outer diameter and extending substantially in a second fiber direction along a weft fiber axis, the weft fiber axis having a predefined angle between ten and eighty degrees with respect to a radial axis; and a plurality of knitted chain stitches securing the plurality of weft fibers to the plurality of circumferential warp fibers;

wherein the plurality of circumferential warp fibers and the plurality of weft fibers are non-interlaced, thereby forming a helical textile having a substantially uniform thickness from the textile inner diameter to the textile outer diameter; and wherein at least one of the plurality of weft fibers extends only partially between the textile inner diameter and the textile outer diameter.

2. The helical textile of claim 1, wherein the predefined angle is between about thirty and about sixty degrees.

3. The helical textile of claim 2, wherein the predefined angle is about forty-five degrees.

4. A helical textile having a substantially uniform thickness comprising:

a plurality of circumferential warp fibers defining a radial textile width from a textile inner diameter to a textile outer diameter, the plurality of circumferential warp fibers extending substantially in a first fiber direction;

a plurality of weft fibers inserted in a weft region between the textile inner diameter and the textile outer diameter and extending substantially in a second fiber direction along a weft fiber axis, the weft fiber axis having a predefined angle greater than zero degrees and less than ninety degrees with respect to a radial axis; and a plurality of knitted chain stitches securing the plurality of weft fibers to the plurality of circumferential warp fibers;

wherein the plurality of circumferential warp fibers and the plurality of weft fibers are non-interlaced, thereby forming a helical textile having a substantially uniform thickness from the textile inner diameter to the textile outer diameter; and wherein the plurality of circumferential warp fibers change between a first hoop position at a first textile radius and a second hoop position at a second textile radius.

5. A helical textile having a substantially uniform thickness comprising:

a plurality of circumferential warp fibers defining a radial textile width from a textile inner diameter to a textile outer diameter, the plurality of circumferential warp fibers extending substantially in a first fiber direction;

a plurality of weft fibers inserted in a weft region between the textile inner diameter and the textile outer diameter and extending substantially in a second fiber direction along a weft fiber axis, the weft fiber axis having a predefined angle greater than zero degrees and less than ninety degrees with respect to a radial axis; and a plurality of knitted chain stitches securing the plurality of weft fibers to the plurality of circumferential warp fibers;

wherein the plurality of circumferential warp fibers and the plurality of weft fibers are non-interlaced, thereby forming a helical textile having a substantially uniform thickness from the textile inner diameter to the textile outer diameter;

wherein the plurality of circumferential warp fibers change between a first hoop position at a first textile radius and a second hoop position at a second textile radius; and wherein the first hoop position and the second hoop position are separated by at least one additional hoop position having a third textile radius between the first textile radius and the second textile radius.

6. The helical textile of claim 1, wherein the plurality of circumferential warp fibers increase in size from the textile inner diameter to the textile outer diameter.

7. The helical textile of claim 1, wherein the plurality of circumferential warp fibers increase in height from the textile inner diameter to the textile outer diameter and decrease in width from the textile inner diameter to the textile outer diameter.

8. The helical textile of claim 7, wherein the plurality of circumferential warp fibers have an equal cross-sectional area.

9. The helical textile of claim 1, wherein the plurality of weft fibers are parallel to one another between the textile inner diameter and the textile outer diameter.

10. The helical textile of claim 1, wherein the plurality of knitted chain stitches secure the plurality of weft fibers to the plurality circumferential warp fibers at every crossover point.

11. The helical textile of claim 1, wherein the weft region has a weft region inner diameter greater than the textile inner diameter.

12. The helical textile of claim 1, wherein the weft region has a weft region outer diameter smaller than the textile outer diameter.

13. The helical textile of claim 11, wherein the weft region has a weft region outer diameter smaller than the textile outer diameter.

14. The helical textile of claim 1, further comprising at least one of the plurality of weft fibers being inserted along a first weft fiber axis between a first radial position and a second radial position and being inserted along a second weft fiber axis between the second radial position and a third radial position, wherein the second radial position is between the textile inner diameter and the textile outer diameter and wherein the first weft fiber axis defines a first angle with respect to the radial axis and wherein the second weft fiber axis defines a second angle with respect to the radial axis, the second angle being different from the first angle.

15. The helical textile of claim 1, wherein at least one of the plurality of weft fibers traverses from the textile inner diameter to a point part of the way towards the textile outer diameter and returns to the textile inner diameter.

16. The helical textile of claim 1, wherein at least one of the plurality of weft fibers traverses from the textile outer diameter to a point part of the way towards the textile inner diameter and returns to the textile outer diameter.

17. The helical textile of claim 1, wherein a radial distance between adjacent ones of the plurality of circumferential warp fibers increases from the textile outer diameter to the textile inner diameter.

18. The helical textile of claim 1, wherein the helical textile has a substantially uniform ratio of weft fiber volume fraction to hoop fiber volume fraction from the textile inner diameter to the textile outer diameter.

19. The helical textile of claim 1, wherein a ratio of weft fiber volume fraction to hoop fiber volume fraction varies by no more than thirty percent from the textile inner diameter to the textile outer diameter.

* * * * *